United States Patent [19]

Farkas et al.

[11] 4,194,143

[45] Mar. 18, 1980

[54] POWER SUPPLY FOR FLASH LAMP

[75] Inventors: Rudolf Farkas, Geneva; Michel Moulin, Lausanne, both of Switzerland

[73] Assignee: Hoffmann-La Roche Inc., Nutley, N.J.

[21] Appl. No.: 953,521

[22] Filed: Oct. 23, 1978

[30] Foreign Application Priority Data

Oct. 27, 1977 [CH] Switzerland ..... 13107/77

[51] Int. Cl.[2] ..... H05B 41/34

[52] U.S. Cl. ..... 315/241 R; 315/205; 315/208; 315/239; 315/240; 320/1; 323/25

[58] Field of Search ..... 315/205, 207, 208, 239, 315/240, 241 R, 243; 320/1; 323/22 SC, 25

[56] References Cited

U.S. PATENT DOCUMENTS

| | | | |
|---|---|---|---|
| 3,127,573 | 3/1964 | Weil | 331/87 |
| 3,588,667 | 6/1971 | Duff et al. | 363/135 |
| 3,614,586 | 10/1971 | King | 307/252 M X |
| 3,749,976 | 7/1973 | Colyn | 315/241 R |
| 3,963,945 | 6/1976 | Colyn | 315/207 X |

FOREIGN PATENT DOCUMENTS

| | | |
|---|---|---|
| 1920951 | 1/1974 | Fed. Rep. of Germany . |
| 2600428 | 5/1978 | Fed. Rep. of Germany . |
| 2264431 | 10/1975 | France . |
| 2272521 | 12/1975 | France . |

*Primary Examiner*—Eugene R. La Roche
*Attorney, Agent, or Firm*—Jon S. Saxe; Bernard S. Leon; Mark L. Hopkins

[57] ABSTRACT

A power circuit for a discharge lamp, in particular a flash lamp serving as light source in an optical analysis apparatus which comprises an electric power source outputting a d.c. voltage and capable of reabsorbing electrical energy, which also comprises an energy transferring circuit inserted between the electric power source and a first capacitor connected to the lamp, the capacitor being charged via the energy transferring circuit and adapted to store the energy required for each discharge across the lamp, the energy transferring circuit comprising a first current path comprising the primary winding of an autotransformer and adapted to transfer current from the electric power source to the first capacitor until the voltage across it reaches a predetermined value, and a second current path comprising a second capacitor for storing part of the surplus or non-used energy stored in the autotransformer during the charging of the first capacitor. To reduce interalia the duration of the charging cycle of the first capacitor, the energy transferring circuit further comprises a third current path comprising the secondary winding of the autotransformer, which path serves for returning the unused energy stored in the autotransformer and in the second capacitor to the electric power source.

3 Claims, 9 Drawing Figures

POWER SUPPLY FOR FLASH LAMP

BACKGROUND OF THE INVENTION

The invention relates to a power supply circuit for a discharge lamp, comprising an electric power source outputting a d.c. voltage and capable of reabsorbing electrical energy, which also comprises an energy transferring circuit inserted between the electric power source and a first capacitor connected to the lamp, the capacitor being charged via the energy transferring circuit and adapted to store the energy required for each discharge across the lamp.

More particularly, the invention relates to a power supply circuit for a flash lamp used as a light source in an optical analysis device such as, for example, a rotary spectrophotometer, i.e. a spectrophotometer in which samples carried by a rotor pass in rapid succession in front of the optical head of the spectrophotometer.

It is known to use supply circuits for discharge lamps used in stroboscopes. A circuit of this kind is described in the publication: "Instruction Manual, Strobotac type 1538-A, General Radio Co.". At each discharge, the last-mentioned circuit supplies a fixed voltage value between the anode and the cathode of the discharge lamp, for producing flashes at an adjustable frequency from 2 Hz to 2500 Hz, in four ranges. The known supply circuit has a number of disadvantages, if intended for use in an optical analysis device:

1. The design of the circuit is such that if the frequency range is high, there is a corresponding reduction in the capacitance of the capacitor supplying energy for each discharge (i.e. the capacitance varies from 1.1 $\mu$F to 0.007 $\mu$F). As a result, the energy available per discharge ($E=CV^2/2$) decreases when the frequency of the discharges increases. Consequently, the charging power ($P=E/\Delta t$ where $\Delta t=1/\Delta f$) remains below 6 W all the frequency ranges, which is quite insufficient for the requirements of rotary spectrophotometers.

2. Since the voltage supplied by the known circuit to the lamp is fixed for each discharge, one cannot modify the light amplitude of the resulting flashes; such modification is desirable, e.g. when the discharge lamp is used as a light source in a spectrophotometer, i.e. when it is necessary to vary the intensity of the light flashes in order to compensate differences in light output at the various wavelengths under consideration, preferably under the control of an automatic programmed system.

3. When it is desired to operate with the maximum energy available for discharging, the frequency of flashes is limited by the time taken to recharge the capacitor supplying energy for each discharge. For example, when the energy available for discharging is at a maximum ($E=1.1\ \mu F\ (800\ V)^2$), the recharging time required is about 80 msec, which corresponds to a relatively low flash frequency and is insufficient for certain applications, e.g. in rotary optical analyzers.

SUMMARY OF THE INVENTION

The invention is based on the problem of devising a discharge lamp supply circuit which does not have the disadvantages of the known supply circuits and is particularly suitable for supplying a discharge lamp used in an optical analysis device, more particularly in a high-speed rotary spectrophotometer.

The supply circuit according to the invention is characterized in that the energy transferring circuit comprises:

a first current path comprising the primary winding of an autotransformer and adapted to transfer current from the electric power source to the first capacitor until the voltage across it reaches a predetermined value;

a second current path comprising a second capacitor for storing part of the surplus or non-used energy stored in the autotransformer during the charging of the first capacitor, and a third current path comprising the secondary winding of the autotransformer, which path serves for returning the unused energy stored in the autotransformer and in the second capacitor to the electric power source.

The invention also relates to the use of the supply circuit according to the invention in an optical analysis device.

The supply circuit according to the invention can be used to eliminate the aforementioned disadvantages of the known supply circuit, and also to obtain the following operating characteristics, using a minimum number of components;

1. The average power delivered in a series of discharges is approximately twenty times the average power obtained with the known circuit.

2. The discharge current pulses have a substantially constant shape and duration and a controlled amplitude which can be varied during the interval between each two successive discharges.

3. The capacitor supplying energy for each discharge can be recharged in less than 1 msec.

4. The energy losses are extremely low.

BRIEF DESCRIPTION OF THE DRAWINGS

The following description, which is by way of example and refers to the accompanying drawings, describes a preferred embodiment of a supply circuit according to the invention. In the drawings.

DESCRIPTION OF THE PREFERRED EMBODIMENT(S)

The supply circuit described hereinafter is adapted to supply a discharge lamp used as a light source in an apparatus for optically analyzing a solution (e.g. the analysis apparatus described in U.S. Pat. No. 3,999,862), more particularly in a rotary spectrophotometer in which samples are examined in very rapid succession. The circuit is used e.g. in cases when the rotary spectrophotometer comprises a rotor bearing thirty samples (contained in optical tubes about 5 mm in diameter) and rotating at 1000 rpm.

Figure 1:
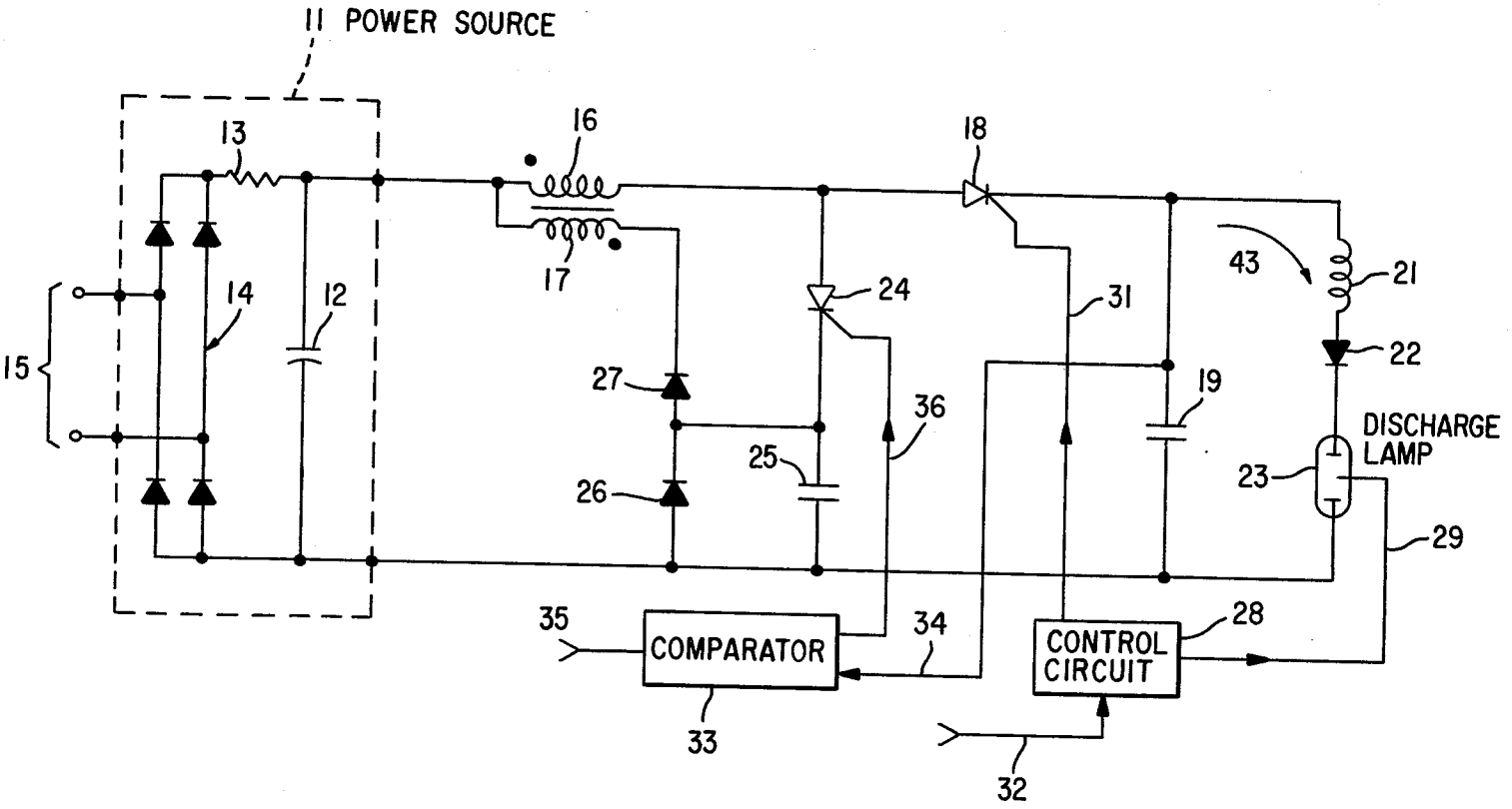
FIG. 1 is a diagram of a supply circuit according to the invention.

The circuit in FIG. 1 comprises an electric power source 11, an autotransformer 16, 17, two capacitors 19 and 25, an inductance coil 21, a discharge lamp 23, two thyristors 18, 24, three diodes 22,26, 27, a comparator 33 and a control circuit 28.

The electric power source 11 comprises e.g. a rectifying bridge 14, a resistor 13 and a filtering capacitor 12. The input 15 of source 11 receives an a.c. voltage, e.g.

from the mains, and delivers a d.c. voltage at its output, i.e. across capacitor 12.

The values of the components used in the circuit in FIG. 1 are as follows:

Resistor 13: 22Ω
Capacitor 12: 330 μF
Capacitor 19: 2 μF
Capacitor 25: 1 μF
Inductance coil 21: 47 μH
Inductance of primary winding 16: 10 mH Ratio of the number of turns in the primary and seconcary winding of autotransformer 16, 17: 1/1.6.

Mains voltage: 220 V, 50 Hz.

Preferably the diodes and thyristors used are high-speed switching types.

Of course, the values given hereinbefore by way of example can be modified to adapt the circuit to the particular conditions in which it is used. For example, the inductance of coil 21 can be reduced if it is desired to produce shorter discharges. In some applications, coil 21 can even be eliminated from the circuit.

The operation of the supply circuit in FIG. 1 will be explained hereinafter with reference to the equivalent circuits in FIGS. 2–6 and the diagrams in FIGS. 7–9.

RECHARGING OF THE FILTER CAPACITOR 12

Capacitor 12 is recharged once every 10 msec by the mains, during which time it supplies energy for five discharges of lamp 23. Resistor 13 limits the charging current of capacitor 12, which is at a maximum when the device is switched on. Capacitor 12 is charged to voltage V 12=300 V by the rectifying bridge 14 and maintains the voltage at substantially the same value during the entire operation of the circuit (see FIG. 7).

THE DISCHARGING CYCLE OF CAPACITOR 19

Figure 8:
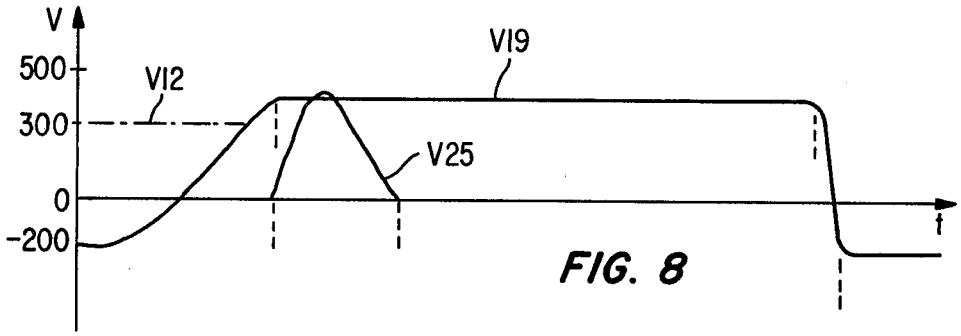

The energy required for each discharge across lamp 23 is previously stored in capacitor 19 in the form of a voltage V19 which is adjustable between 150 and 600 V, e.g. V19=400 V (see FIG. 8).

Input 32 of control circuit 28 receives a synchronization signal for bringing about the required synchronism between the ignition of lamp 23 and the operation of the sample-presenting mechanism in the spectrophotometer.

When actuated by the synchronizatiion signal, the control circuit 28 supplies an ignition pulse along line 29 to the electrode for igniting lamp 23, at the instant $t_6$ (see FIG. 9), whereupon capacitor 19 discharges via a series circuit comprising coil 21, diode 22 and discharge lamp 23. FIG. 9 shows the corresponding current pulse 43.

Owing to the presence of inductance 21, the current pulse 23 is approximately in the form of a semi-sinusoid. This shape is suitable for processing the resulting optical signal in the spectrophotometer amplifiers. The duration of the semi-sinusoid, which is chosen between 10 and 30 μsec, is approximately equal to:

$$t_7-t_6=\pi\sqrt{L_{21}\cdot C_{19}}$$

where $L_{21}$=inductance of coil 21, and
$C_{19}$=capacitance of capacitor 19.

In this example, the amplitude of current pulse 43 is approximately 200 A. Owing to the scale used, FIG. 9 shows only a part of this pulse.

During the discharge, a large part (60% to 90%) of the energy stored in capacitor 19 is dissipated in lamp 23 and converted into light and heat energy. However, owing to the oscillation of the discharge circuit (i.e. of capacitor 19 connected in series with coil 21, diode 22 and lamp 23 during the discharge), the remaining energy (40% to 10%) is left in capacitor 19 in the form of a negative voltage of approximately 200 V (see V19 in FIG. 8) when the voltage to which capacitor 19 is charged before each discharge is V19=400 V.

THE CHARGING CYCLE OF CAPACITOR 19

Figure 5:
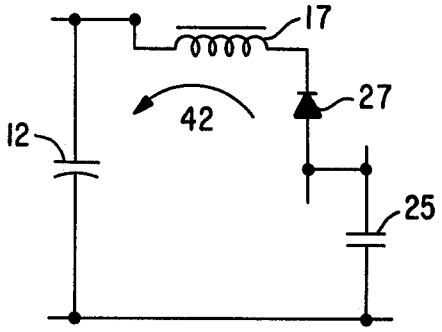
Figure 6:
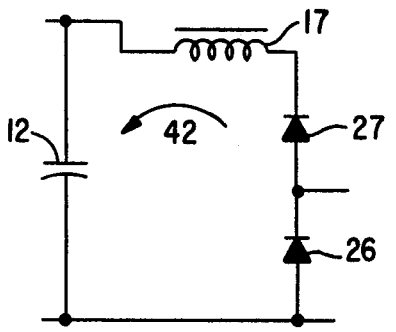
Figure 7:
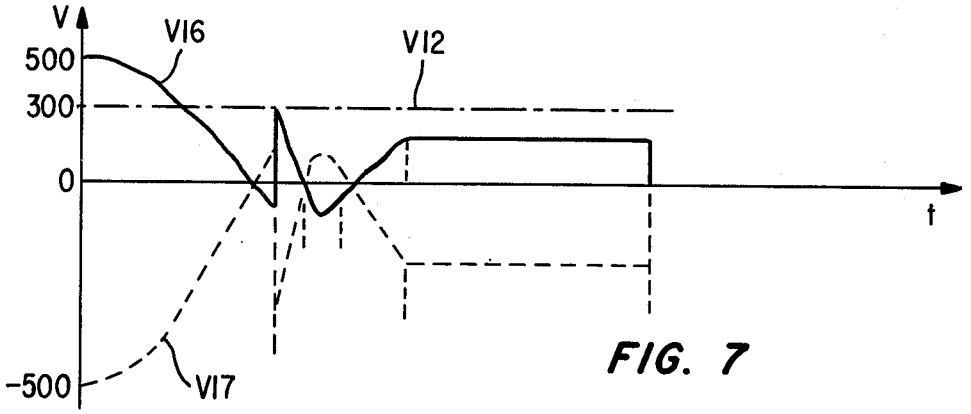
FIGS. 7–9 are voltage and current diagrams also used for explaining the operation of the circuit in FIG. 1.
Figure 9:
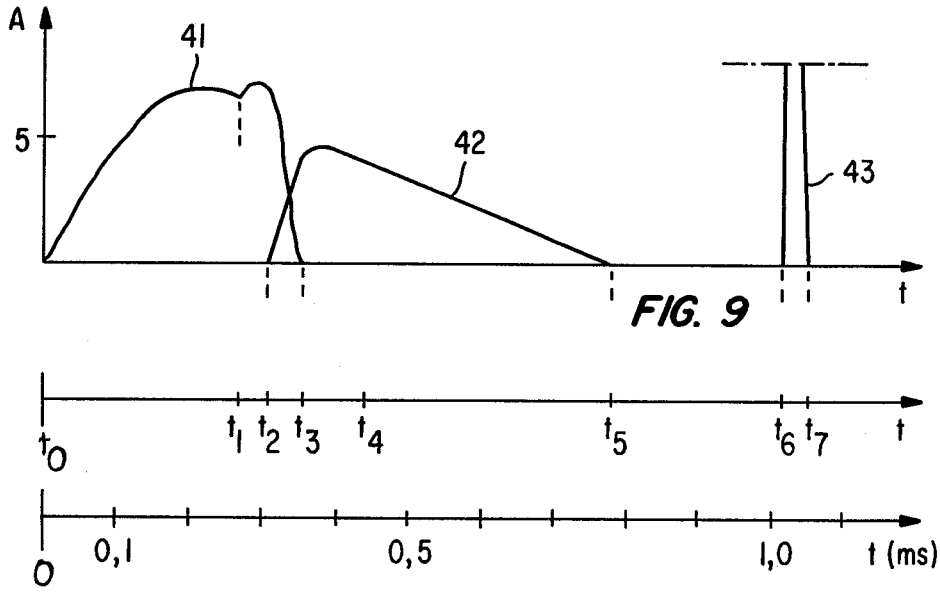

The explanation of this cycle can be simplified by referring to the equivalent circuits in FIGS. 2–6 and considering the following intervals, which are shown in the graphs in FIGS. 7–9.

Figure 2:
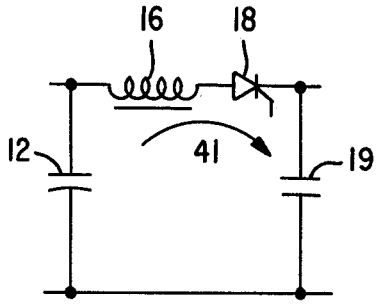
FIGS. 2–6 are equivalent circuits for explaining the operation of the circuit of FIG. 1.

INTERVAL FROM $t_0$ TO $t_1$ (SEE FIG. 2)

As previously stated voltage V19 of capacitor 19 remains negative after each discharge via lamp 23. During the interval from $t_0$ to $t_1$, capacitor 19 is charged from the aforementioned negative voltage to a positive voltage which is adjustable between 150 and 600 V in order to supply the energy required for the next discharge. To this end, the control circuit 28 makes thyristor 18 conductive by supplying it with a control signal along line 31 at instant $t_0$. Upon conduction of thyristor 18 the equivalent circuit in FIG. 2 is established, and an oscillating current 41 charging capacitor 19 begins to flow from the source through the primary winding 16 and the thyristor 18. The oscillation period $T_a$ is mainly determined by the relation:

$$T_a=2\sqrt{L_{16}\cdot C_{19}}$$

in which $L_{16}$=inductance of primary winding 16 and
$C_{19}$=capacitance of capacitor 19.

During the oscillation, the energy present in capacitor 19 at $t_0$ is transferred to the primary winding 16; V19 rises towards zero and current 41 increases.

If thyristor 24 and diodes 26, 27 were absent, the oscillation would stop when the corresponding current 41 returned to zero, the final value of the voltage V19' being determined by the relation:

$$V19'=-V19_0 2\ V12$$

where $V19_0$ is the value of V19 at instant $t_0$ ($V19_0=-200$ V in this example, see FIG. 9).

However, before V19 reaches the level V19', comparator 33 detects that the voltage V19 applied to its input 34 is reaching the desired level (e.g. +400 V) determined by the reference signal applied to its input 35. Thereupon (at instant $t_1$) comparator 33 makes thyristor 24 conductive by supplying it with a control signal along line 36. Since capacitor 25 is discharged (V25=0 at $t_1$), an inverse voltage V19–V25 is applied to thyristor 18 and switches it off. Thus, the recharging of capacitor 19 comes to an end but the cycle is not complete, since surplus energy is stored in the form of current 41 in the primary autotransformer winding 16. The rest of the cycle is used for returning this energy to the capacitor 12 of the electric power source 11.

Figure 3:
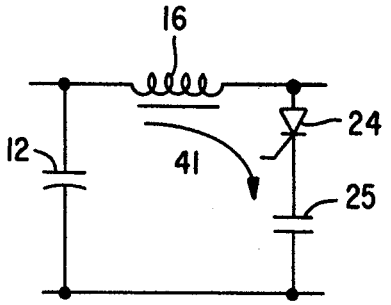

INTERVAL FROM $t_1$ to $t_2$ (SEE FIG. 3)

At instant $t_1$, thyristor 24 begins to conduct the current 41, which thereupon charges capacitor 25, whose voltage V25 begins to rise (see FIG. 8). The corresponding period of oscillation $T_b$ is defined by:

$$T_b = 2\pi\sqrt{L_{16} \cdot C_{25}}$$

in which $L_{16}$=inductance of primary winding 16, and $C_{25}$=capacitance of capacitor 25.

At instant $t_2$, V25 reaches level V12, so that diode 27 can begin to conduct.

Figure 4:
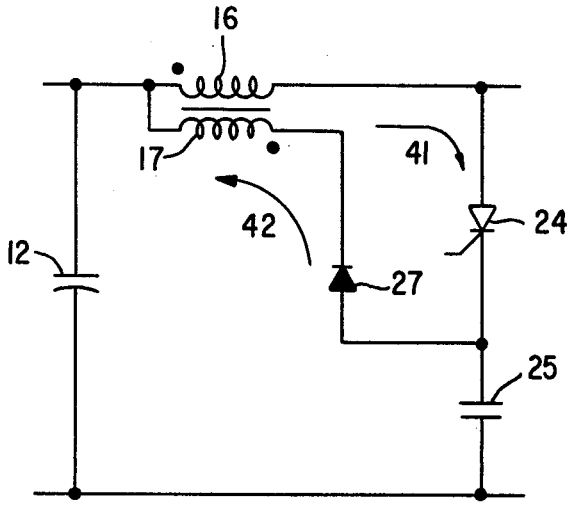

INTERVAL FROM $t_2$ to $t_3$ (SEE FIG. 4)

From the time when diode 27 begins to conduct, the two windings 16, 17 are in antiparallel connection. Accordingly, the oscillation period is determined by $C_{25}$ and the leakage inductances in the two windings, and is appreciably shorter than $T_b$:

FIG. 9 shows that in the interval from $t_2$ to $t_3$ the current 42 increases whereas current 41 decreases to zero. The energy stored in the primary winding 16 is transferred to the secondary winding 17. Voltage V25 (FIG. 8) reaches its maximum value when current 41 is equal to current 42.

The ratio between the number of turns in the secondary and the primary autotransformer winding must be chosen between 1.4 and 1.6, to ensure that current 41 decreases more quickly than current 42 increases.

At instant $t_3$, current 41 reaches zero value and thyristor 24 switches off.

INTERVAL FROM $t_3$ to $t_4$ (SEE FIG. 5)

During this interval, the new oscillating circuit comprising the secondary winding 17 and capacitor 25 oscillates with the following period:

$$T_d = 2\pi\sqrt{L_{17} \cdot C_{25}}$$

in which $L_{17}$=inductance of secondary winding 17, and $C_{25}$=capacitance of capacitor 25.

Current 42 discharges capacitor 25 and returns the energy stored therein and in autotransformer 16–17 to source 11. Voltage V25 (see FIG. 8) of capacitor 25 decreases to zero and current 42 begins to decrease.

At instant $t_4$, voltage V25 becomes zero and is held at that level since diode 26 conducts when V25 tends to become negative.

INTERVAL FROM $t_4$ to $t_5$ (see FIG. 6)

During this interval, the intensity I 42 (t) of current 42 continues to decrease approximately in accordance with the following relation (neglecting ohmic losses):

$$I42(t) = I42\ (t_4) - (V12.t/L_{17})$$

where $I42(T_4)$=current 42 at instant $t_4$.

At instant $t_5$, current 42 becomes zero and the charging cycle is over. Thereupon, all conduction stops. Capacitor 19 is ready for the next discharge and capacitor 25, at voltage $V_{25}=0$, is ready for the new charging cycle after the discharge.

FIG. 7 shows the variation of voltages V16 and V17 at windings 16, 17 respectively during the interval from $t_0$ to $t_5$.

The supply circuit according to the invention has the following advantages:

1. It supplies the energy required to produce "packets" of 150 flashes separated by inoperative intervals of ten seconds (between packets). The maximum energy per flash is 0.25J and the interval between flashes is 2 msec inside a "packet", which lasts 300 msec. This corresponds to an average charging power of 125W during the "packet", i.e. an average charging power about twenty times as great as that supplied by the known supply circuit mentioned in the introduction of this specification. The average charging power $P_m$ mentioned hereinbefore is defined as:

$$P_m = (n \times e_d / T_p)$$

wherein n=number of flashes per packet.

$e_d$=energy per flash, and $T_p$=duration of a packet of flashes.

2. The circuit can be used to vary the voltage applied between the anode and cathode of the discharge lamp within a ratio of 1:4 (e.g. from 150 to 600 V), so that the light intensity of the flashes can be varied within a ratio of nearly 1:10. In this manner, the light intensity of the flahses can be adapted to the measuring requirements, e.g. to the optical yield at various wavelengths, thus obtaining optimum measuring conditions. The voltage applied to the lamp can be varied in the interval between two successive flashes, since the variation is electronically controlled by means of the reference voltage applied to comparator 33.

3. The supply circuit according to the invention provides the energy for producing flashes having the desired light intensity and can also be used for operating at a flash frequency suitable for rotary spectrophotometers. This is possible owing to the short time needed to recharge the capacitor supplying energy for each discharge. In the previously described example, the cycle for recharging capcitor 19 lasts less than 1 msec.

4. Energy losses are extremely low. In the supply circuit according to the invention, the energy remaining in capacitor 19 is recovered after each discharge and the surplus energy stored in primary winding 16 is likewise recovered after charging the capacitor 19.

5. Advantages 1–4 hereinbefore can be obtained with a minimum number of electronic components.

6. In addition, the preferred embodiment of the previously described invention comprises an inductance coil 21 in series with the discharge lamp. By means of this coil, the discharge current pulse 43 is given the approximate shape of a semi-sinusoid, having a constant duration determined by the inductance of coil 21 and the capacitance of capacitor 19. This avoids producing light pulses having a straight flank, which would be disadvantageous in a spectrophotometer, since the photometer detection circuit would need to have a relatively wide pass-band, thus adversely affecting the signal-to-noise ratio of the measurement.

The supply circuit according to the invention can also be used e.g. to supply a discharge lamp used as a light source in a manual spectrophotometer for making chemical clinical analyses and enzyme measurements. The supply circuit according to the invention can also be used in stroboscopy and photography.

What is claimed is:

1. A power supply circuit for a discharge lamp, having an electric power source outputting a d.c. voltage and capable of reabsorbing electrical energy, and further having an energy transferring circuit inserted between the electric power source and a first capacitor connected to the lamp, the capacitor being charged via the energy transferring circuit and adapted to store the energy required for each discharge across the lamp, wherein the energy transferring circuit comprises:

a first current path comprising the primary winding of an autotransformer and adapted to transfer current from the electric power source to the first capacitor until the voltage across it reaches a predetermined value, a second current path comprising a second capacitor for storing part of the surplus energy stored in the autotransformer during the charging of the first capacitor, and a third current path comprising the secondary winding of the autotransformer, which path serves for returning the unused energy stored in the autotransformer and in the second capacitor to the electric power source.

2. A supply circuit according to claim 1, wherein a diode is connected in parallel with the second capacitor, the conduction sense of the diode being such that it is blocked while the second capacitor stores said surplus energy.

3. Use of the supply circuit according to claim 1 in an optical analysis device.

* * * * *